US008100643B2

(12) United States Patent
Leblanc et al.

(10) Patent No.: US 8,100,643 B2
(45) Date of Patent: Jan. 24, 2012

(54) CENTRIFUGAL COMPRESSOR VANE DIFFUSER WALL CONTOURING

(75) Inventors: André Leblanc, Saint Bruno (CA); Eugene Gekht, Brossard (CA); François Doyon, Longueuil (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 449 days.

(21) Appl. No.: 12/433,117

(22) Filed: Apr. 30, 2009

(65) Prior Publication Data

US 2010/0278643 A1 Nov. 4, 2010

(51) Int. Cl.
*F04D 29/44* (2006.01)

(52) U.S. Cl. ..... 415/208.2

(58) Field of Classification Search .... 415/208.2–208.4, 415/211.1, 914
See application file for complete search history.

(56) References Cited

U.S. PATENT DOCUMENTS

| | | | | |
|---|---|---|---|---|
| 2,373,713 | A | | 4/1945 | Shoults |
| 2,735,612 | A | | 2/1956 | Hausmann |
| 2,918,254 | A | | 12/1959 | Hausamman |
| 3,039,736 | A | | 6/1962 | Pon |
| 3,578,264 | A | | 5/1971 | Kuethe |
| 3,917,434 | A | | 11/1975 | Bandukwalla |
| 3,953,147 | A | * | 4/1976 | Aspinwall ..... 415/143 |
| 4,135,857 | A | | 1/1979 | Pannone et al. |
| 4,349,314 | A | * | 9/1982 | Erwin ..... 415/181 |
| 4,354,802 | A | | 10/1982 | Nishida et al. |
| 4,420,288 | A | | 12/1983 | Bischoff |
| 4,624,104 | A | | 11/1986 | Stroem |
| 4,824,325 | A | | 4/1989 | Bandukwalla |
| 4,850,795 | A | | 7/1989 | Bandukwalla |
| 4,877,370 | A | | 10/1989 | Nakagawa et al. |
| 4,877,373 | A | | 10/1989 | Bandukwalla |
| 5,310,309 | A | | 5/1994 | Terasaki et al. |
| 6,213,711 | B1 | | 4/2001 | Muller et al. |
| 6,540,481 | B2 | * | 4/2003 | Moussa et al. ..... 415/208.2 |

* cited by examiner

*Primary Examiner* — Gary F. Paumen

(74) *Attorney, Agent, or Firm* — Norton Rose OR LLP

(57) ABSTRACT

Diffusion in the vane island passages of a centrifugal compressor diffuser is in part controlled by contouring the diffuser passage wall with low profile surface variations. The surface variations can be provided in the form of flow boundary disrupting protrusions disposed within the downstream portion of the vane island passages to prevent flow separation.

20 Claims, 5 Drawing Sheets

CENTRIFUGAL COMPRESSOR VANE DIFFUSER WALL CONTOURING

TECHNICAL FIELD

The application relates generally to gas turbine engines and, more particularly, to vane island diffusion passage configurations in centrifugal compressor vane diffusers.

BACKGROUND OF THE ART

The flow field within the vane island passages of a centrifugal compressor diffuser is complex and includes a number of secondary flows which are a major source of energy loss. One phenomena generally regarded of importance is boundary layer separation. When the fluid next to a diffuser wall (the boundary layer) separates from the wall there is a loss in diffusing area and pressure recovery is reduced, i.e. the diffuser performance is degraded. Various attempts have been made in the past to modify the design of centrifugal compressor vane diffusers to eliminate/reduce such flow separation problems. For example, some designs include sequential sets of vane islands as well as front splitter at the leading edge of the vane islands. These designs generally increases the size of the diffuser which is a disadvantage in that it makes gas turbine engine designs more complicated and expensive.

Therefore, there is a need for a simple method of modifying the centrifugal compressor diffuser design to specifically address flow separation problems in vane island passages.

SUMMARY

In one aspect, there is provided a centrifugal compressor vane diffuser for receiving high velocity air from an impeller mounted for rotation about an axis of a gas turbine engine compressor, the diffuser comprising front and back walls defining an axial gap therebetween, a circumferential array of vane islands extending from the front wall to the back wall to define therewith a plurality of vane island passages, the vane islands having leading edges located on an inner circumference and trailing edges located on an outer circumference, the inner and outer circumferences being centered relative to the axis of rotation of the impeller, and a series of low profile flow boundary disrupting protrusions circumferentially staggered relative to said circumferential array of vane islands and disposed in said vane island passages, the low profile flow boundary disrupting protrusions projecting a short distance from one of said front and back walls to a flow boundary region of the vane island passages, each of the flow boundary disrupting protrusions having a chord length extending between a leading edge and a trailing edge, the chord length of the flow boundary disrupting protrusions being smaller than that of the vane islands, the flow boundary disrupting protrusions being contained between said inner and outer circumferences, and the leading edges of the flow boundary disrupting protrusions being located radially outward from said inner circumference.

In a second aspect, there is provided a gas turbine engine centrifugal compressor comprising an impeller mounted for rotation about an axis and a vane diffuser disposed around an outer periphery of the impeller to decrease the velocity and increase the static pressure of the air from the impeller, the vane diffuser having a pair of axially spaced-apart flow boundary surfaces defining an axial gap therebetween, a circumferential array of vane islands spanning said axial gap between the axially spaced-apart flow boundary surfaces and defining therewith a plurality of vane island passages, and a circumferential array of low profile protrusions circumferentially staggered relative to said circumferential array of vanes islands, the circumferential array of low profile protrusions being contained in a downstream portion of said vane island passages relative to a flow direction of the air through the diffuser, the low profile protrusions forming geometrical surface variations at one of said flow boundary surfaces.

In a third aspect, there is provided a centrifugal compressor vane diffuser surrounding an impeller mounted for rotation about an axis of a gas turbine engine compressor, the diffuser comprising confronting front and back walls defining an axial gap therebetween, a circumferential array of vane islands extending from the front wall to the back wall to divide the axial gap into a plurality of vane island passages, the vane islands having leading edges located on an inner circumference and trailing edges located on an outer circumference, the inner and outer circumferences being centered relative to the axis of rotation of the impeller, wherein each of said vane island passages has a flow boundary surface area extending between adjacent vane islands on one of said front and back walls, said flow boundary surface area having an uneven surface profile configured to locally increase a velocity of a flow boundary layer in a downstream portion of each of the island vane passages.

DESCRIPTION OF THE DRAWINGS

Reference is now made to the accompanying figures, in which.

DETAILED DESCRIPTION OF THE PREFERRED EMBODIMENTS

Figure 1:
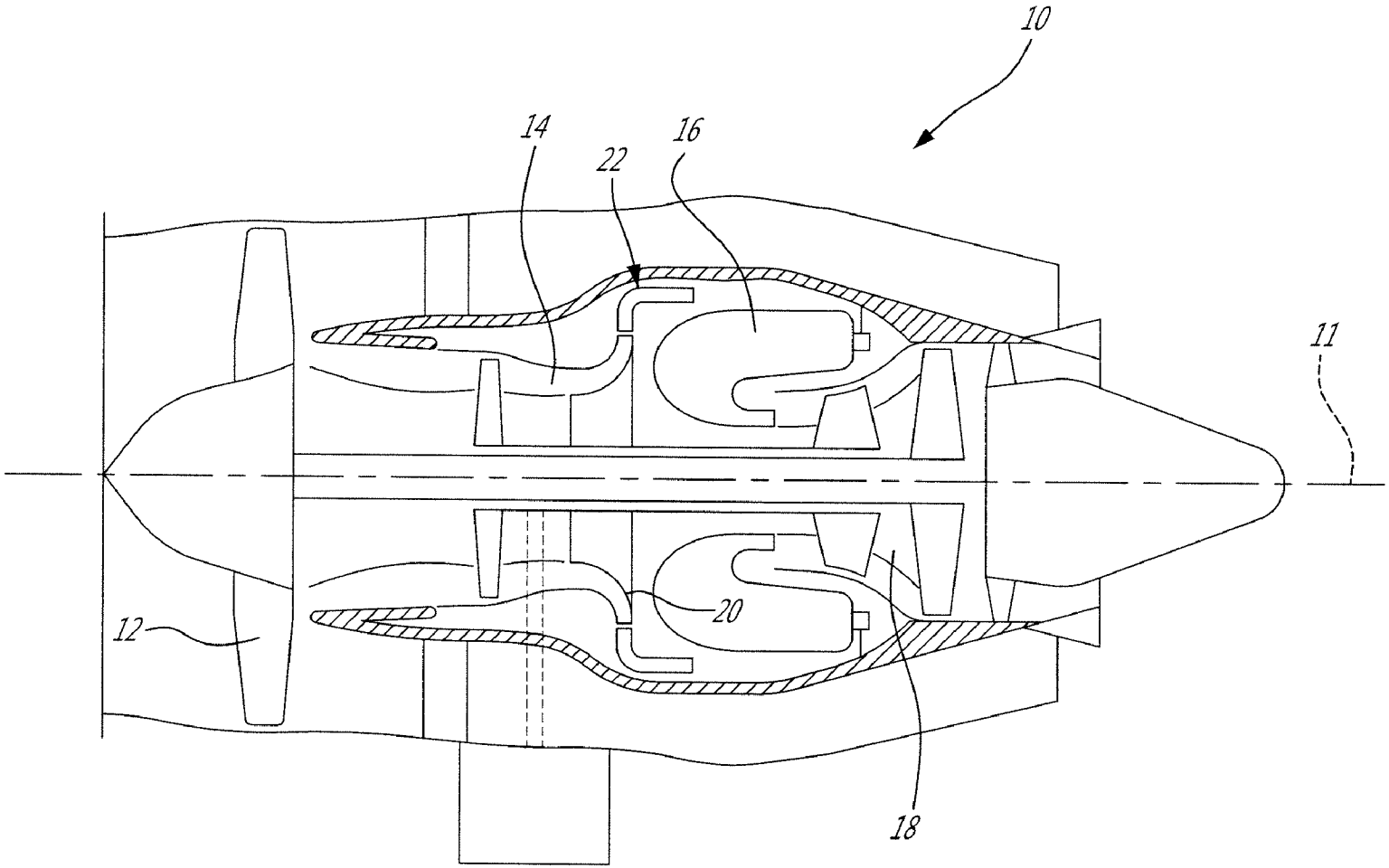
FIG. 1 is a schematic cross-sectional view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 3:
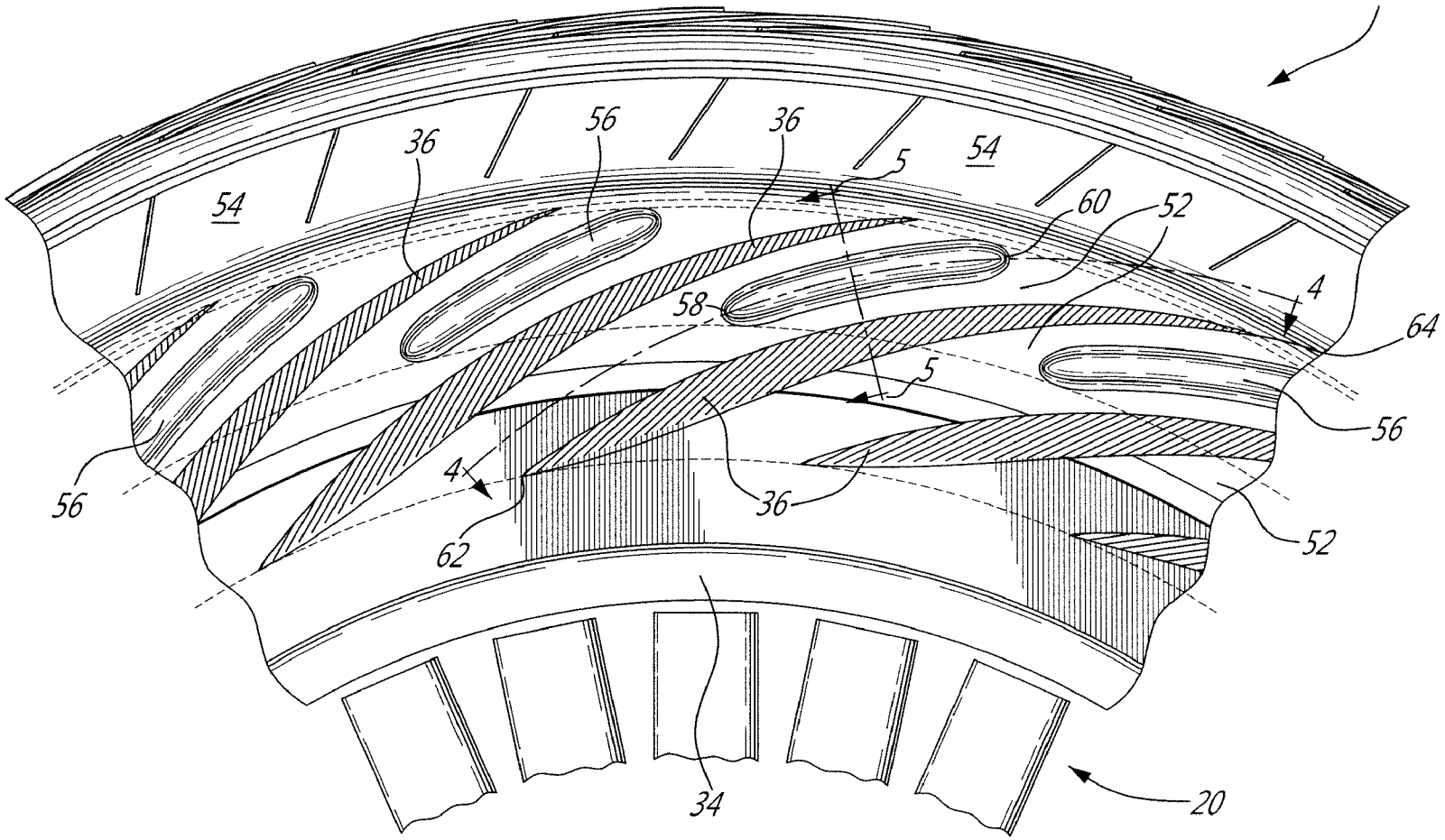
FIG. 3 is a partial front cross-sectional view of the centrifugal compressor vane diffuser disposed around the periphery of an impeller of the gas turbine engine compressor, illustrating the disposition of subtle flow boundary disrupting protrusions in the vane island passages of the diffuser.

As shown in FIG. 3, the compressor has a centrifugal stage comprising a bladed rotor or impeller 20 mounted for rotation about the engine central axis 11 (FIG. 1). The impeller 20 discharges air with radial and circumferential velocity components into a stationary vane diffuser 22 disposed around the periphery of the impeller 20 for receiving the air and converting the kinetic energy of the air to pressure energy before the air be delivered to the combustor 16.

Figure 2:
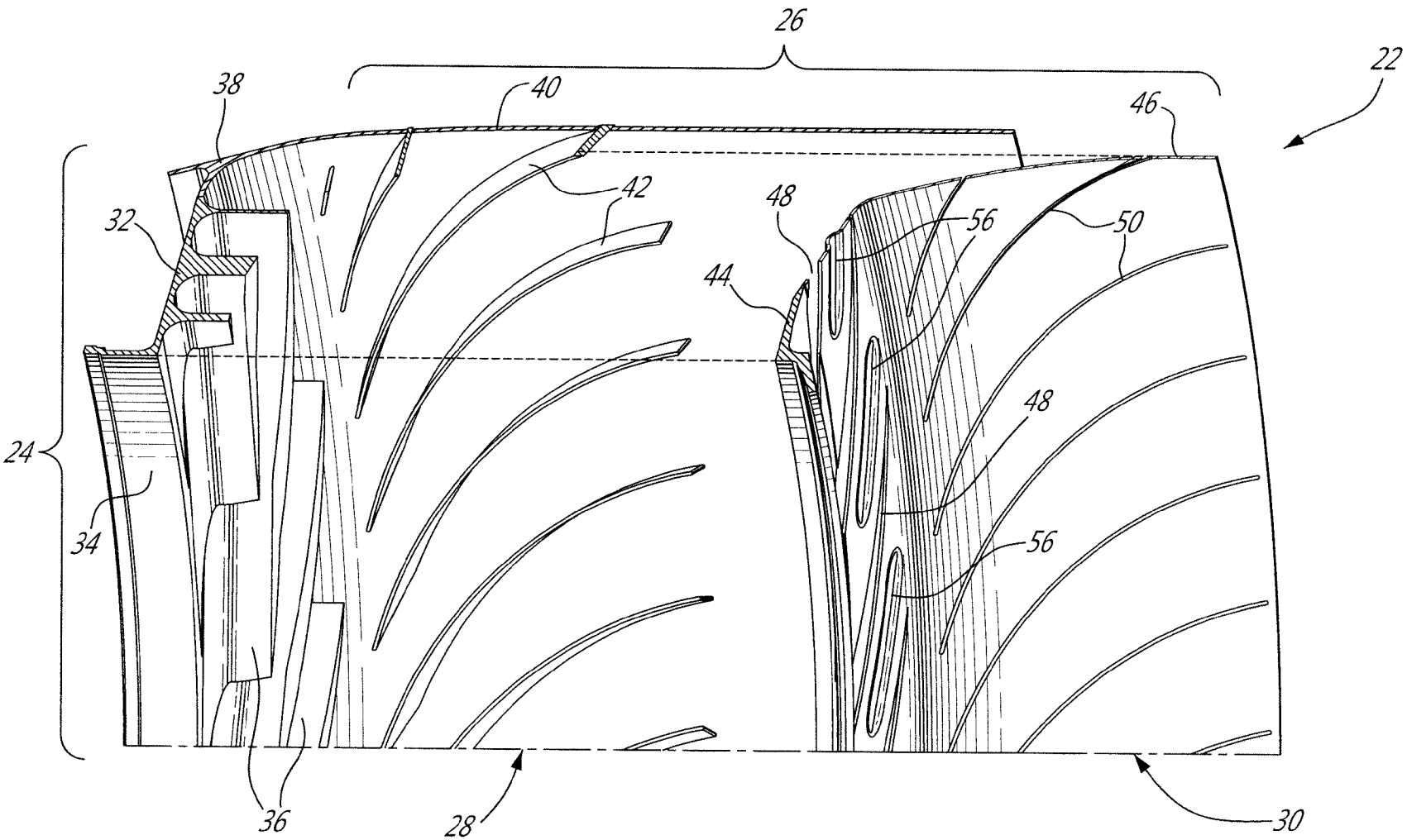
FIG. 2 is a partial longitudinal cross-sectional exploded view of a centrifugal compressor vane diffuser of the engine shown in FIG. 1.

As shown in FIG. 2, the diffuser 22 has a radial portion 24 and a downstream axial portion 26 for redirecting the air from a generally radial direction to a diffused annular axial rearward flow into the combustor 16. The diffuser 22 can be of a two-piece construction and generally comprises an integrated opened island diffuser casing 28 and a separate sheet metal cover 30. The casing 28 and the cover 30 can be bowl-shaped and the cover 30 can be concentrically nested in the casing 28 and secured thereto by appropriate means.

The casing 28 comprises and open-vane disc or wall 32 having an inner rim 34 circumscribing a central impeller opening. A circumferential array of vane islands 36 are formed on an inner surface or flow boundary surface of wall 32. As will be seen hereinafter, the vane islands 36 extend between the inner rim 34 and the periphery of wall 32 to form together with the cover 30 and wall 32 a series of vane island passages. The outer periphery of wall 32 merges into an arcuate vaneless annular wall portion 38 defining a 90° bend from radial to axial. Wall portion 38 then merges into an axially extending annular outer wall portion 40. A circumferential row of deswirl vanes 42 are provided on the inner surface of the axial wall portion 40 to cooperate with the cover 30 to form a series of diffuser outlet flow passages.

The cover 30 has a disc-shaped wall 44 and an axially extending annular wall 46 projecting rearwardly from the periphery of wall 44. Slots 48 and 50 can be respectively defined in walls 44 and 46 for receiving the free distal ends of the vane islands 36 and deswirl vanes 42 after the cover 30 has been appropriately nested into the bowl-shaped casing 28. Brazing paste can be provided in the slots 48 and 50 to permit attachment of the cover 30 to the casing 28 by brazing. However, it is understood that other joining techniques could be used as well.

Once the cover 28 as been assembled to the casing 28, the confronting disc-shaped walls 32 and 44 define an axial gap which is divided in a plurality of sectorial vane island passages 52 (see FIGS. 3 and 5) by the vane islands 36. Likewise, the deswirl vanes 42 divide the radial gap between the axially extending annular walls 40 and 46 into a series of diffuser outlet flow passages 54 (FIG. 3). The outlet flow passages are in fluid flow communication with the vane island passages for discharging an annular axial flow to the combustor 16.

Under certain conditions, the air flowing through the island vane passages 52 between the vane islands 36 may be subject to flow separation. This is essentially due to the flow boundary layers along the confining wall of a fluid passage having a lower velocity than the reminder of the flow. The pressure gradient in the flow adjacent to the confining wall (i.e. the pressure gradient in the flow boundary layer region) can be adjusted to prevent flow separation problems by applying a proper wall contour at the diffuser wall. More particularly, as shown in FIGS. 2 to 5, this can be done by wall contouring the disc-shaped wall 44 of the cover 30 so as to form a circumferential array of low profile flow boundary disrupting protrusions 56 in the vane island passages 52. The shape and position of such surface variations in the flow boundary wall between the vane islands 36 allows to better control the aerodynamic loading in the vane island passages 52 to avoid separation problems.

As can be appreciated from FIG. 3, the circumferential array of low profile flow boundary disrupting protrusions 56 is circumferentially staggered relative to the circumferential array of vane islands 36 such that each protrusion 56 be substantially centrally disposed in a pitch wise direction between confronting pressure and suction surfaces of each pair of adjacent vane islands 36. The subtle or low profile protrusions 56 have a chord length which extends between a leading edge 58 and a trailing edge 60. Likewise, the vane islands 36 have a chord length which extends between a leading edge 62 and a trailing edge 64. From FIG. 3, it can be readily appreciated that the chord length of the protrusions 56 is smaller than that of the vane islands 36. The chord length of the low profile flow boundary disrupting protrusions 56 is about 30% to about 50% of the chord length of the vane islands 36.

From FIG. 3, it can also be appreciated that the protrusions 56 are fully contained in the vane island passages 52 that is between the inner and outer circumferences on which the leading and trailing edges 62 and 64 of the vane islands 36 are respectively disposed. The protrusions 56 are disposed in the downstream half portion of the vane island passages 52 relative to the direction of the air flowing therethrough. The trailing edges 60 of the protrusions 56 can be disposed slightly radially inward from the trailing edges 64 of the vane islands. The protrusions 56 have can have elongated racetrack shape having with a chordwise curvature generally corresponding to that of the vane islands 36.

Figure 4:
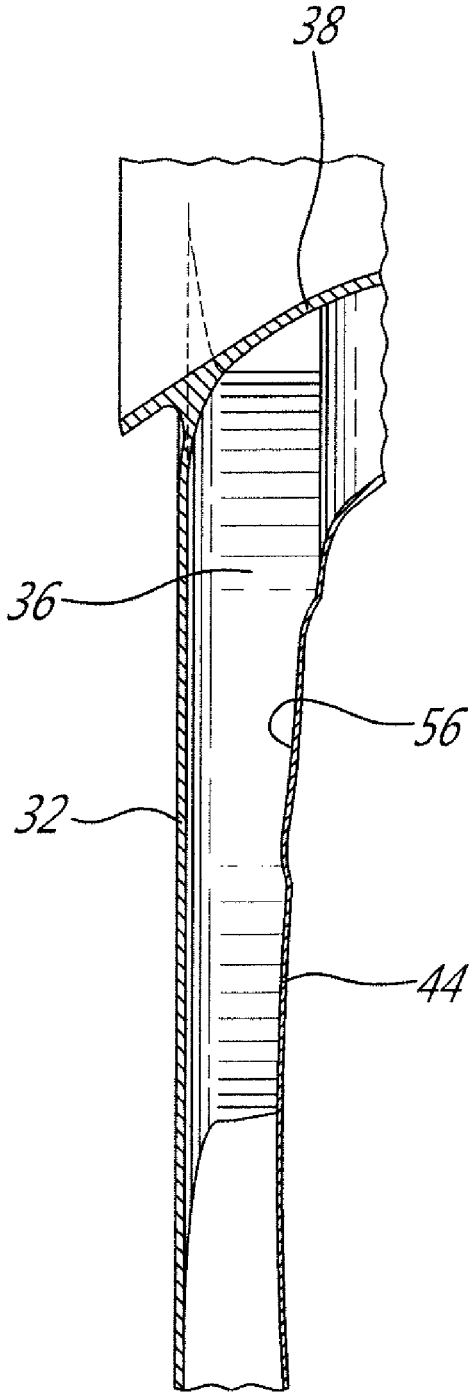
FIG. 4 is a partial radial sectional view of the vane diffuser taken along line 4-4 in FIG. 3.
Figure 5:
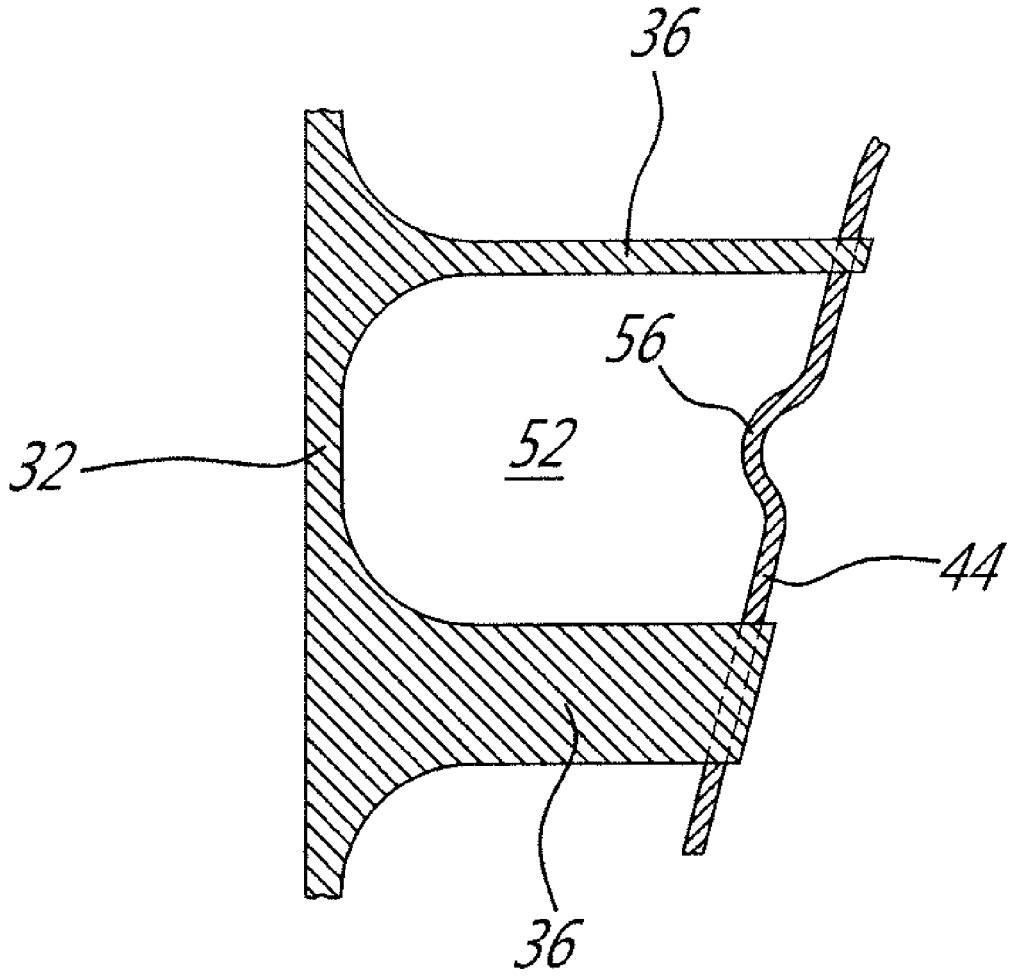
FIG. 5 is a cross-sectional view taken along line 5-5 in FIG. 3 and illustrating the low rounded profile of the flow boundary disrupting protrusions.

The low profile or small height of the protrusions 56 can be appreciated from FIGS. 2, 4 and 5. Unlike, the vane islands 36 which span the full gap between diffuser walls 32 and 44, the protrusions 56 are superficial and only project a short distance from wall 44 to the flow boundary region next to wall 44. The height of the protrusions 56 can vary depending on the size and configuration of the diffuser but it is generally comprised between about ⅛ to about 1/10 of the vane island height.

As shown in FIGS. 2 and 5, the protrusions 56 can be provided in the form of a "bump" having a rounded cross-sectional shape. This surface geometry provides for smooth local transitions at the flow boundary surface of wall 44.

When formed in sheet-metal wall surfaces as disclosed hereinabove, the low profile flow boundary disrupting protrusions 56 can conveniently be obtained by inducing a series of localised deformations or indentations in the sheet metal material. Such surface deformations or indentations do not require the introduction of a body but a simple wall contouring that can for instance be achieved by pressing or punching operations. It is also understood that the low profile protrusions 56 could be machined, cast or otherwise provided depending on the material of the wall surface on which they are provided.

In operation, the low profile flow boundary disrupting protrusions 56 accelerate the flow boundary layer next to wall 44 and thereby locally change the flow pressure of the flow in this flow boundary region. This provides an effective method of reducing secondary flow losses without having to increase the radial envelope of the diffuser to accommodate sequential set of vane islands in the radial section 24 of the diffuser 22.

The above description is meant to be exemplary only, and one skilled in the art will recognize that changes may be made to the embodiments described without departing from the scope of the invention disclosed. For example, the protrusions 56 could be provided on the inner surface or flow boundary surface of diffuser wall 32 rather than on the diffuser wall 44. Also other surface modulations or surface profiles could be applied to each flow boundary surface areas between the vane islands 36 to provide for uneven diffuser flow confining surfaces (as opposed to conventional smooth diffuser flow boundary surfaces) in the downstream end portions of the vane island passages 52. Still other modifications which fall within the scope of the present invention will be apparent to those skilled in the art, in light of a review of this disclosure, and such modifications are intended to fall within the appended claims.

What is claimed is:

1. A centrifugal compressor vane diffuser for receiving high velocity air from an impeller mounted for rotation about an axis of a gas turbine engine compressor, the diffuser comprising front and back walls defining an axial gap therebetween, a circumferential array of vane islands extending from the front wall to the back wall to define therewith a plurality of vane island passages, the vane islands having leading edges located on an inner circumference and trailing edges located on an outer circumference, the inner and outer circumferences being centered relative to the axis of rotation of the impeller, and a series of low profile flow boundary disrupting protrusions circumferentially staggered relative to said circumferential array of vane islands and disposed in said vane island passages, the low profile flow boundary disrupting protrusions projecting a short distance from one of said front and back walls to a flow boundary region of the vane island passages, each of the flow boundary disrupting protrusions having a chord length extending between a leading edge and a trailing edge, the chord length of the flow boundary disrupting protrusions being smaller than that of the vane islands, the flow boundary disrupting protrusions being contained between said inner and outer circumferences, and the leading edges of the flow boundary disrupting protrusions being located radially outward from said inner circumference.

2. The centrifugal compressor vane diffuser as defined in claim 1, wherein the trailing edges of the flow boundary disrupting protrusions are located radially inwardly of the outer circumference on which the trailing edges of the vane islands are disposed.

3. The centrifugal compressor vane diffuser as defined in claim 1, wherein the flow boundary disrupting protrusions are disposed in the downstream half portion of the vane island passages in the chordwise direction relative to a direction of flow of the air through the vane island passages.

4. The centrifugal compressor vane diffuser as defined in claim 3, wherein the chord length of the flow boundary disrupting protrusions is about 30% to about 50% of the chord length of the vane islands.

5. The centrifugal compressor vane diffuser as defined in claim 1, wherein the height of the flow boundary disrupting protrusions is about 1/10 to about 1/8 of the height of the vane islands.

6. The centrifugal compressor vane diffuser as defined in claim 1, wherein the flow boundary disrupting protrusions are provided in the form of wall surface deformations.

7. The centrifugal compressor vane diffuser as defined in claim 1, wherein each of the flow boundary disrupting protrusions is provided in the form of an elongated race track shape corrugation defined in said one of said front and back walls.

8. The centrifugal compressor vane diffuser as defined in claim 7, wherein each of the corrugations has a rounded cross-sectional shape.

9. The centrifugal compressor vane diffuser as defined in claim 1, wherein said protrusion have a chordwise curvature which generally corresponds to that of the vane islands.

10. A gas turbine engine centrifugal compressor comprising an impeller mounted for rotation about an axis and a vane diffuser disposed around an outer periphery of the impeller to decrease the velocity and increase the static pressure of the air from the impeller, the vane diffuser having a pair of axially spaced-apart flow boundary surfaces defining an axial gap therebetween, a circumferential array of vane islands spanning said axial gap between the axially spaced-apart flow boundary surfaces and defining therewith a plurality of vane island passages, and a circumferential array of low profile protrusions circumferentially staggered relative to said circumferential array of vanes islands, the circumferential array of low profile protrusions being contained in a downstream portion of said vane island passages relative to a flow direction of the air through the diffuser, the low profile protrusions forming geometrical surface variations at one of said flow boundary surfaces.

11. The centrifugal compressor defined in claim 10, wherein the low profile protrusions have a height corresponding to not more than about 1/8 of the height of the vane islands.

12. The centrifugal compressor defined in claim 10, wherein the low profile protrusions have a height which is comprised between about 1/10 to about 1/8 of the height of the vane islands.

13. The centrifugal compressor defined in claim 10, wherein said low profile protrusions are provided in the forms of localized wall deformations in said one of said flow boundary surfaces.

14. The centrifugal compressor defined in claim 10, wherein said low profile protrusions have a rounded cross-sectional shape.

15. The centrifugal compressor defined in claim 10, wherein said low profile protrusions have an elongated shape with a substantially constant thickness along a major portion of a length thereof.

16. The centrifugal compressor defined in claim 10, wherein said low profile protrusions have a chord length which ranges from about 30% to about 50% of that of the vane islands.

17. The centrifugal compressor wherein said low profile protrusions are localized indentations of said one of said flow boundary surfaces into the vane island passages.

18. A centrifugal compressor vane diffuser surrounding an impeller mounted for rotation about an axis of a gas turbine engine compressor, the diffuser comprising confronting front and back walls defining an axial gap therebetween, a circumferential array of vane islands extending from the front wall to the back wall to divide the axial gap into a plurality of vane island passages, the vane islands having leading edges located on an inner circumference and trailing edges located on an outer circumference, the inner and outer circumferences being centered relative to the axis of rotation of the impeller, wherein each of said vane island passages has a flow boundary surface area extending between adjacent vane islands on one of said front and back walls, said flow boundary surface area having an uneven surface profile configured to locally increase a velocity of a flow boundary layer in a downstream portion of each of the island vane passages.

19. A centrifugal compressor vane diffuser as defined in claim 18, wherein the uneven surface profile comprises a surface deformation in the form of a low profile protrusion extending between each pair of adjacent vane islands in the back wall of the diffuser.

20. A centrifugal compressor vane diffuser as defined in claim 18, wherein the uneven surface profile are provided in the form of elongated rounded indentations in one of said front and back walls.

* * * * *